United States Patent [19]

Visser et al.

[11] Patent Number: 5,027,634

[45] Date of Patent: Jul. 2, 1991

[54] SOLUTIONIZING TAPER QUENCH

[75] Inventors: James T. Visser, Ada; Charles B. Gentry, Belmont, both of Mich.

[73] Assignee: Granco-Clark, Inc., Belding, Mich.

[21] Appl. No.: 486,480

[22] Filed: Feb. 28, 1990

[51] Int. Cl.[5] ..... B21C 29/00; B21C 33/00

[52] U.S. Cl. ..... 72/270; 72/253.1; 72/342.5; 72/342.6; 72/342.94; 72/364; 148/11.5 A

[58] Field of Search ..... 72/253.1, 270, 342.2, 72/342.5, 342.6, 342.94, 364, 201, 259; 266/87, 259; 148/11.5 A, 11.5 B

[56] References Cited

U.S. PATENT DOCUMENTS

| | | | |
|---|---|---|---|
| 783,716 | 2/1905 | Brinkman | 72/128 |
| 1,951,501 | 3/1934 | Busse | 72/253.1 |
| 2,107,510 | 2/1938 | Skinner et al. | 72/370 |
| 2,193,891 | 3/1940 | Talbot-Crosbie et al. | 72/342.2 |
| 2,305,811 | 12/1942 | Oeckl | 266/259 |
| 2,409,422 | 10/1946 | Egan . | |
| 2,480,774 | 8/1949 | Rossheim . | |
| 2,639,810 | 5/1953 | Doan | 72/342.94 |
| 2,863,557 | 12/1958 | Munker . | |
| 2,964,838 | 12/1960 | Schober . | |
| 3,019,144 | 1/1962 | Murphy et al. | 72/257 |
| 3,210,978 | 10/1965 | Scheil | 72/39 |
| 3,212,309 | 10/1965 | Wilson | 72/8 |
| 3,222,227 | 12/1965 | Baugh et al. | 148/11.5 R |
| 3,267,709 | 8/1966 | O'Brien | 72/13 |
| 3,613,418 | 10/1971 | Nara et al. | 72/201 |
| 3,668,917 | 6/1972 | Komatsu | 72/342.3 |
| 3,739,619 | 6/1973 | Follrath | 72/255 |
| 3,796,849 | 3/1974 | Cuvelier | 266/259 |
| 3,889,507 | 6/1975 | Kranenberg et al. | 72/201 |
| 3,902,334 | 9/1975 | Stuart | 72/128 |
| 4,059,896 | 11/1977 | Asari | 72/253.1 |
| 4,070,884 | 1/1978 | Grube et al. | 72/201 |
| 4,245,818 | 1/1981 | Elhaus et al. | 266/87 |
| 4,308,742 | 1/1982 | Harrison et al. | 72/364 |
| 4,909,858 | 3/1990 | Reiso | 148/11.5 A |

FOREIGN PATENT DOCUMENTS

| | | | |
|---|---|---|---|
| 701817 | 1/1965 | Canada | 72/270 |
| 2278417 | 2/1976 | France | 72/270 |
| 158221 | 12/1981 | Japan | 72/253.1 |
| 776690 | 11/1980 | U.S.S.R. | 72/253.1 |
| 447884 | 5/1936 | United Kingdom | 72/270 |
| 889451 | 2/1962 | United Kingdom | 72/364 |

OTHER PUBLICATIONS

American Society for Metals, "Metals Handbook," 8th Ed., vol. 1, 1961, p. 935.

American Society for Metals, "Metals Handbook," 8th Ed., vol. 2, 1964, p. 271.

Proceedings of the 4th International Aluminum Extrusion Technology Seminar, "The Effect of Billet Preheating Practice on Extrudability of AlMgSi Alloys,".

*Primary Examiner*—Robert L. Spruill

*Attorney, Agent, or Firm*—Varnum, Riddering, Schmidt & Howlett

[57] ABSTRACT

A method and apparatus for conditioning an aluminum billet for extrusion from an extrusion press. The billet is first heated above the solutionizing temperature for the MgSi phases in the aluminum matrix, then the billet is cooled below the solutionizing temperature to an adequate hot working temperature. Preferably, a temperature gradient is created along the length of the billet wherein one end of the billet is at or above the hot working temperature and the other end of the billet is cooled to a temperature below the hot working temperature. Thereafter, the billet is placed into the extrusion die, the hot end adjacent the die and the cool end adjacent the ram of the extrusion press. The billet is then extruded producing an extruded product with uniform properties along the length of the product with minimal defects such as tearing or hot shorting.

37 Claims, 11 Drawing Sheets

SOLUTIONIZING TAPER QUENCH

TECHNICAL FIELD

This invention relates to billet conditioning for aluminum extrusion operations and, more particularly, to a solutionizing taper quench for such billets.

BACKGROUND OF THE INVENTION

The quality of an extrusion of an aluminum billet is dependent upon, among other things, the temperature of the billet during the extrusion operation and the speed with which the extrusion operation proceeds. Generally, it is known that as the temperature of the billet immediately prior to extrusion increases, the speed with which the extrusion process may proceed decreases. However, the lower temperature may also result in defects in the extruded product as a result of the hard and brittle MgSi phases within the aluminum matrix. Obviously, it is most desirable to maximize the extrusion speed to increase the productivity of the extrusion apparatus. However, the extrusion speed is limited by the temperature of the billet and the existence of hard incipient phases in the matrix. As described in an article by Oddvin Reiso entitled, "The Effect of Billet Preheating Practice on Extrudability of AlMgSi Alloys," published in the 1988 Proceedings of the Fourth Intermediate Aluminum Extrusion Technology Seminar, defects in the extruded billet can be minimized by heating an AlMgSi billet above the solutionizing temperature to dissolve any MgSi phases contained within the aluminum matrix prior to extrusion. Thereafter, the billet is cooled somewhat to an adequate working temperature, but not sufficient to allow for significant reformation of the solutionized MgSi phases. At this working temperature, the billet may be extruded at a maximum extrusion speed with minimal defects in the extruded product.

It is also well known to create a temperature differential throughout a metal billet prior to an extrusion operation in order to eliminate defects in the extruded products and to create more uniform properties throughout the extruded product. The temperature gradient is created between the ends of the billet. The temperature gradient may be used to create an extrusion which has a uniform temperature upon exiting the extrusion die by compensating for the heat created in the billet as a result of the extrusion operation. The temperature gradient may also be utilized to help remove impurities such as air from the billet during the extrusion operation through selective deformation of the billet.

The U.S. Pat. No. 2,639,810 to Doan (issued May 26, 1953) discloses the concept of extruding a metal billet having a temperature gradient between the ends. The metal billets are pretreated to establish a temperature gradient extending from a hot working temperature at one end to a materially lower temperature at the other end While this gradient exists, the billet is extruded with the hot end adjacent the die with the result that any air in the cylinder is expelled positively from around the billet rearwardly along the ram and out of the press. The temperature gradient can be created by spraying one end of the billet with water or by standing the billet on one end momentarily in a shallow pool of water after heating the billet to a uniform hot-working temperature.

A further example of creating a temperature gradient throughout a heated workpiece is disclosed in the U.S. Pat. No. 2,409,422 to Egan (issued Oct. 15, 1946). The patent discloses a means for creating a temperature differential in a bi-metallic billet in a hot-rolling operation by subjecting one of the components of the billet to spray from a cooling medium.

Use of a temperature gradient is also disclosed in U.S. Pat. No. 2,480,774 to Rossheim, et al. (issued Aug. 30, 1949) for application in bending of thin walled thermoplastic bodies including tubes. The gradient is created by employing heating means that circumscribe the tube and cooling rings on either side of the heating means. The U.S. Pat. No. 3,902,334 to Stuart (issued Sept. 2, 1975) also discloses the use of heating and cooling rings which circumscribe a tube to allow for uniform bending of the tube.

An extrusion operation which measures the temperature of the extruded product and utilizes sprays from various cooling mediums to cool the extruded product is disclosed in U.S. Pat. No. 2,863,557 to Munker (issued Dec. 9, 1958). The temperature sensing means are used to control the speed of the extrusion. This concept is also found in U.S. Pat. No. 3,212,309 to Wilson (issued Oct. 19, 1965). In the Wilson patent, a temperature sensing device is used to control the speed of a wire drawing machine and the amount of coolant applied to the drawn wire.

The U.S. Pat. No. 2,964,834 to Schober (issued Dec. 20, 1960) also utilizes a temperature gradient within a metal blank to create desired properties in the end product in a forging operation. This patent discloses creating a temperature gradient within a metal blank prior to a forging operation to allow for free and uniform movement of the metal to the extreme portions of the forging die as the force of the press is applied. This method also creates a one-directional grain structure at the extremities of the die.

The concept of applying coolant to an extruded article immediately after the extrusion operation is found in U.S. Pat. No. 3,739,619 to Follrath, et al. (issued June 19, 1973).

SUMMARY OF THE INVENTION

According to the invention, a method for conditioning an aluminum billet for extrusion comprises the steps of heating an aluminum billet to a temperature sufficient to solutionize the elements in the aluminum matrix, cooling the billet to a temperature below the solutionizing temperature and non-uniformly to produce a temperature gradient along the length thereof, wherein one end of the billet has a temperature above the hot working temperature and the other end is below the hot working temperature of the billet. Next, the billet is placed in an extrusion die and extruded by placing the hot end adjacent the die opening and the cooler end adjacent the ram. The cooler portions of the billet will heat to a temperature at or above the hot working temperature as the billet is extruded so that the extrusion resulting therefrom have substantially uniform properties along the length thereof and hot shorting of the extrusions is minimized.

This method is particularly well suited for aluminum alloys which include magnesium and silicon wherein the solutionizing temperature in the range of 960° to 1010° F. is achieved prior to cooling. Solutionizing the billet prior to extrusion is important to break up the hard, brittle MgSi phases contained within the aluminum matrix. These phases will cause defects in the extruded product if they are not solutionized prior to extrusion. In addition, because of the lower melting point of these phases, extrusion at a high temperature will cause defects in the extruded product known as tearing. Therefore, it is important to cool the billet somewhat prior to extrusion. This cooling temperature should be in a suitable range for hot working the billet.

Hot working temperatures for this method may be in the range of 500° to 950° F. Further, the cool end of the billet may be cooled by as much as 200° F. with respect to the other end of the billet during the cooling step of the method. Therefore, the MgSi phases are solutionized during the heating process and then reappear after the billet has been cooled to the hot working temperature. However, the solutionizing and cooling process minimizes the deleterious effects of the MgSi phases to the extrusion operation resulting in an extruded product with minimal defects such as tearing or hot shorting.

Further, according to the invention, an apparatus for conditioning a billet for extrusion after the billet has been heated above the solutionizing temperature comprises cooling means for directing cooling fluid in a uniform band around the billet, means for moving the billet with respect to the cooling means such that the billet passes through the cooling means, and control means for controlling the relative movement of the billet with respect to the cooling means to develop a temperature gradient along the length of the billet. The cooling means have an opening for passing the billet therethrough and the billet moves through at least a portion of the cooling means. The billet cooling means creates the temperature gradient along the length of the billet as the billet passes through the cooling means to reduce the temperature of the billet below the solutionizing temperature.

The control means compromises means to control the flow of cooling fluid to the cooling means and means for detecting the temperature of the billet. Any suitable cooling fluid may be used for example, water, air, or oil. Through the application of the cooling means, the control means develops a predetermined temperature profile along the length of the billet. The temperature may be measured before and/or after the billet passes through the cooling means by the temperature means. The temperature may be measured by any suitable means, the preferred embodiment utilizes a conventional chromel-alumel thermocouple rod.

The billet moving means comprises a frame having guide rails to support the billet, a pusher, a nozzle support flange, a pusher support for the pusher and nozzle support flange, a nozzle cover, a reversible motor and guide means. The pusher support is supported by the guide means above the guide rails. The pusher support mounts the pusher and nozzle support flange in spaced relationship for contacting opposite ends of the billet. The nozzle cover is mounted to the nozzle support flange to contact one end of the billet. The motor is connected to the pusher support to move the solutionized billet from the conveyor along the guide rails reciprocally through the cooling means preferably in a direction transverse to the conveyor.

The cooling means used to cool the billet below the solutionizing temperature comprises at least one spray ring to distribute the cooling fluid in a circular band around the heated billet. The cooling means can also incorporate a nozzle for directing cooling fluid against one end of the billet for the enhancement of a temperature gradient along the length of the billet. The spray ring, in a preferred embodiment, has means to direct an air spray and a water spray in closely adjacent relationship to help contain the cooling water.

The cooling means preferably incorporates two or more spray rings spaced axially from each other to direct the cooling fluid onto the billet in a circular band by a plurality of nozzles radially directed at the billet to direct cooling fluid upon the billet. The conditions within the cooled billet at the end of the cooling operation may be varied by altering the axial spacing between the spray rings.

The spray ring comprises a plate with a circular opening therethrough and a plurality of nozzles which are formed on an inside surface of the circular opening. The plate further incorporates a central recess which is in communication with each of the nozzles. Further, means for supplying the cooling fluid to the central recess are included. The spray ring has a radial opening on the upper most portion of the ring to permit passage of the pusher elements therethrough.

The cooling of the heated billet may be accomplished by a variety of methods to produce numerous different temperature conditions within the billet. The billet can be passed through the spray ring at a uniform speed and be subjected to a uniform rate of application of the cooling medium and result in a billet of uniform temperature. Alternatively and preferably, a temperature gradient can be created along the length of the billet by passing the cooled billet through the spray ring by controlling the speed of the billet through the spray ring or by applying a variable rate of cooling medium to the billet. If the billet speed through the cooling ring accelerates as the billet passes through the ring, the end of the billet which passed through more slowly will be at a lower temperature than the other end of the billet which passes through the spray ring at a quicker rate because it has been subjected to more cooling medium from the spray ring. The movement means may also be programmed so that only a portion of the billet moves through the ring. The rate of application of the cooling medium to the billet may also be varied as the billet passes through the spray rings. If the rate of application is increased as the billet passes through the ring, the initial end of the billet passing through the ring will be hotter than the other end of the billet which was subjected to a greater amount of cooling medium. In addition, the cooling medium can be directed against the billet in a wide variety of fashions such as a constant stream, a pulsating flow, or a series of pulses or blasts.

An end quench can be applied to one end of the billet to enhance the temperature differential within the billet, either individually or in conjunction with the spray rings, through the use of the end nozzle. The nozzle within the end quench means can direct cooling medium against one of the ends of the billet in a variety of manners to achieve the temperature differential. The nozzle can apply the cooling medium by a constant stream, a series of pulses or blasts or by an increasing or decreasing rate of cooling medium. The spray ring and the end quench means can be combined to create a wide variety of temperature conditions within the billet depending upon the particular needs for the particular alloy and the extrusion operation.

The preferred embodiment envisions removing the solutionized billet from the conveyor and passing the billet through the entire length of the spray ring. The spray ring applies a uniform stream of cooling medium to the entire length of the billet. Thereafter, the moving means reverses direction and the nozzle cover engages the other end of the billet and once again pushes the billet through the spray ring back toward the conveyor. During this return action, the nozzle of the end quench means can be used to create a greater temperature differential within the billet. In addition, the flow of the cooling medium in the spray rings can be varied, and the speed of movement through the spray rings can be varied to enhance the temperature gradient along the length of the billet. The control means can be programmed to a wide variety of alternatives based upon the variable factors of the cooling means.

BRIEF DESCRIPTION OF DRAWINGS

The invention will now be described in detail with reference to the accompanying drawings wherein.

DESCRIPTION OF THE PREFERRED EMBODIMENT

Figure 1:
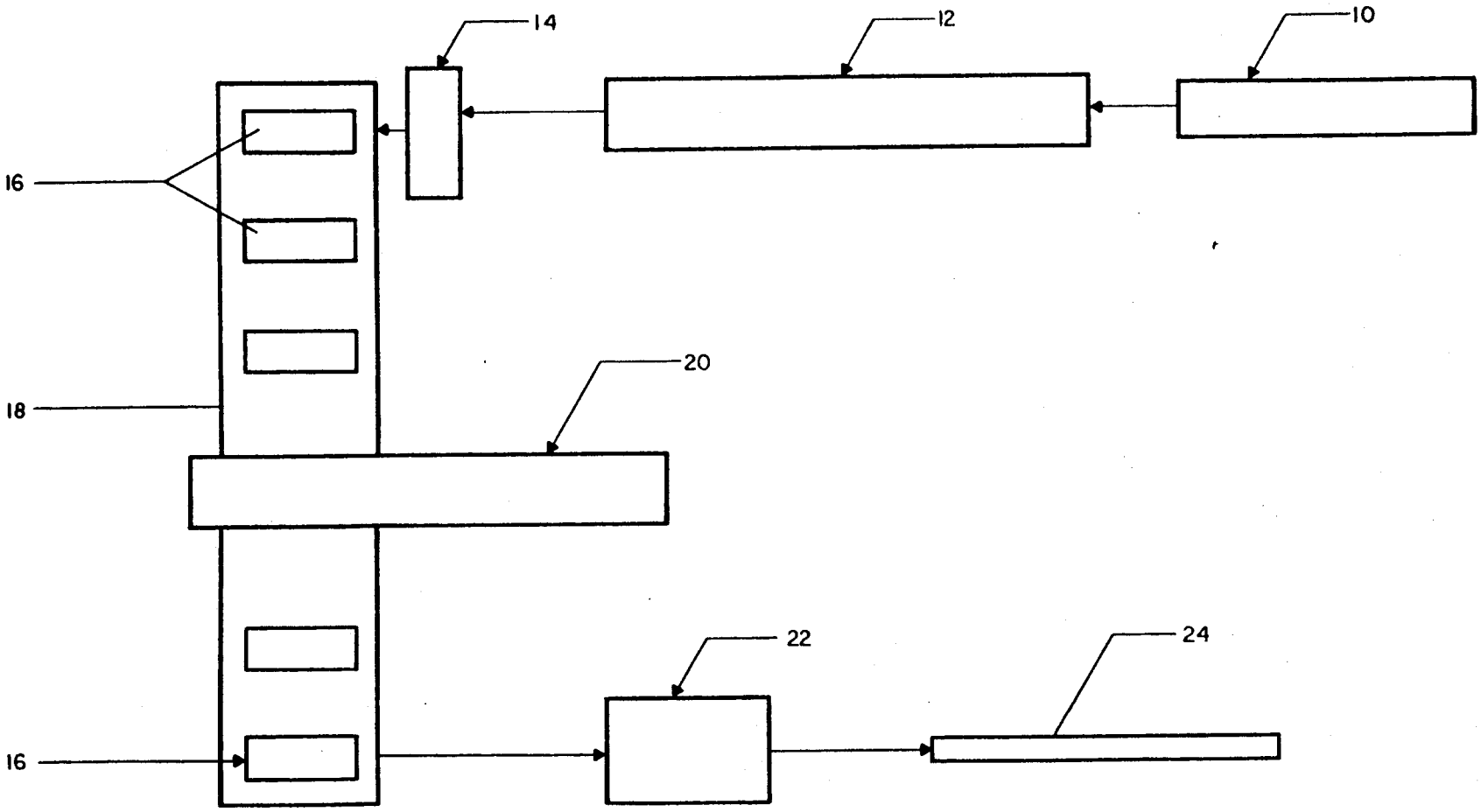
FIG. 1 is a schematic plan view of the conditioning apparatus according to the invention showing an extrusion operation.

Referring now to the drawings and to FIG. 1 in particular, billet logs 10 are introduced into a billet heating furnace 12 where the logs are heated sufficiently to solutionize the alloying components, such as MGSi phases, in the Al matrix. This temperature will vary with the chemical composition of the aluminum alloy. The billet logs 10 are removed from the billet heating furnace by a conventional pusher conveyor (not shown) and are introduced into a conventional shear 14. The shear 14 cuts the billet logs 10 into billets 16 of varying sizes depending upon the extrusion operation. Adjacent the shear 14 is a billet conveyor 18 which transfers the billets from the shear 14 to a taper quench apparatus 20. The taper quench apparatus 20 cools the heated billet 16 to the desired working temperature and at the same time preferably creates a temperature gradient along the length of the billet, as described below. The working temperature of the billet and any temperature gradient therein will determine the extrusion speed during the extrusion operation. After the quenching operation of the taper quench apparatus 20, the billet 16 is returned to the billet conveyor 18, transferred to a point adjacent to an extrusion press 22 and is loaded into the press 22. The press 22 then extrudes the billet 16 and thus creates an extrusion 24 with the desired properties based upon the solutionizing temperature of the billet heating furnace 12, the quench operation of the taper quench apparatus 20, and the speed of the extrusion from the press 22. The billet 16 is loaded into the extrusion press 22 with the hottest end of the billet 16 adjacent the die (not shown).

Figure 2:
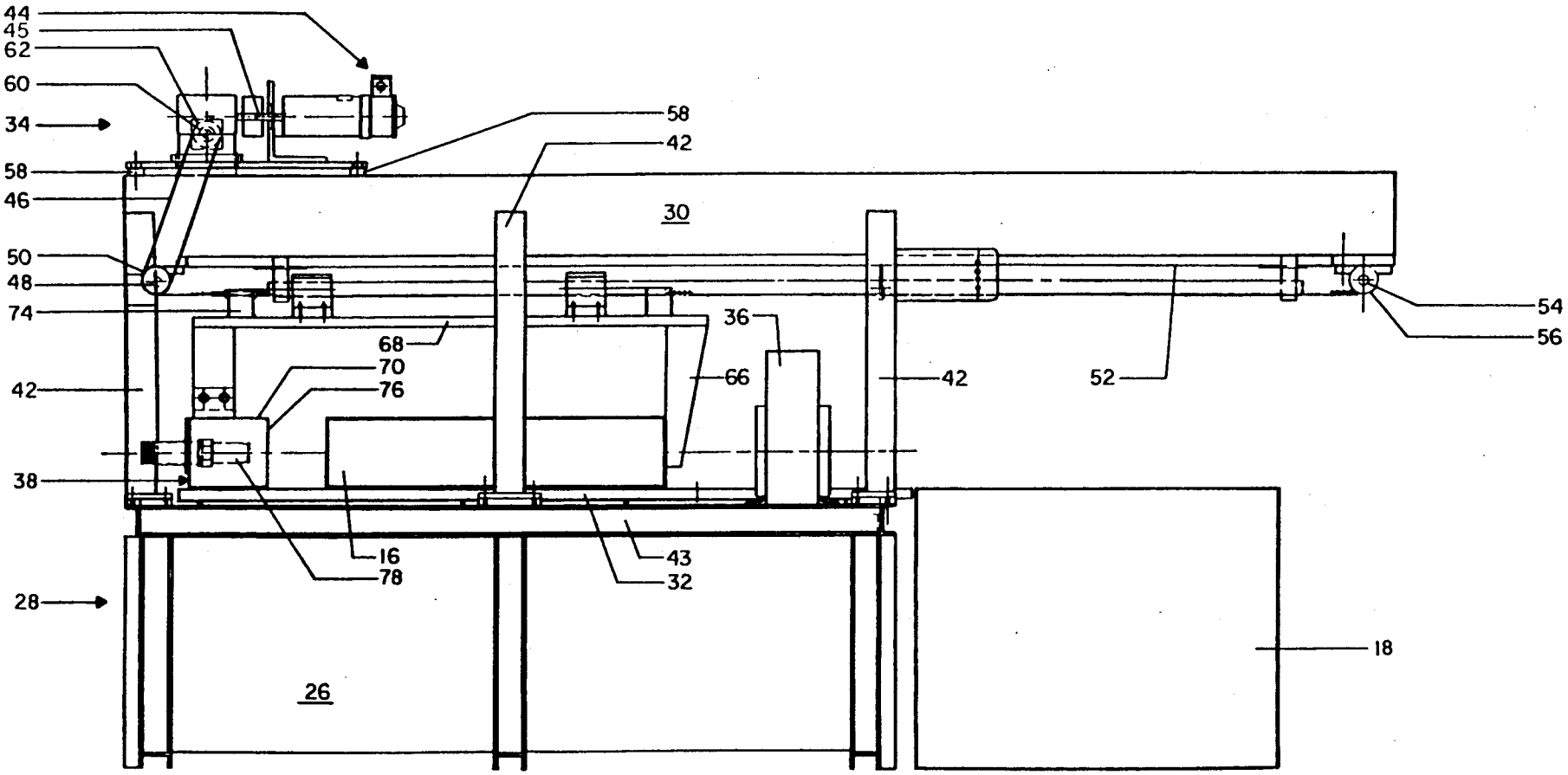
FIG. 2 is a side elevational view of the solutionizing taper quench apparatus according to the invention.

FIG. 2 shows the taper quench apparatus 20 in greater detail. The apparatus 20 comprises the billet conveyor 18, cooling means, and moving means 34 for the billet 16. The cooling means comprises a cooling medium reservoir 26, a spray ring housing 36, and end quench means 38. The moving means for the billet 16 comprises a support frame 28, a horizontal guide beam 30, and guide rails 32. The billet conveyor 18 is adjacent to one end of the reservoir 26 and the support frame 28. The support frame 28 comprises a plurality of support legs 42 which are fixedly attached to a plurality of horizontal cross members 43. In turn, the support legs 42 are fixedly attached to and provide support for the horizontal guide beam 30. The guide beam is mounted above the entire length of the reservoir 26 and guide rails 32 and also overhangs the billet conveyor 18.

Mounted above and below the horizontal guide beam 30 are the moving means for the billet 16. The moving means 34 comprise a conventional reversible electric motor 44 having an output shaft 45 and connected to an endless power chain 46 through a rotatable axle 48, gears 50 and 51 mounted to the rotatable axle 48, a conveyor chain 52, a second rotatable axle 54, and a second gear 56. The electric motor 44 is mounted to the top surface of the horizontal guide beam 30 by suitable support means 58. The electric motor 44 provides a rotational torque to the power chain 46 by a rotating axle 60 and gear 62. The motor 44 turns the axle 60 which is fixedly attached to the gear 62 around which the power chain 46 is drawn. The other end of the power chain 46 is drawn around gear 50. The electric motor 44 turns the rotating axle 60 and gear 62 which in turn rotate the power chain 46 and the gear 50 and axle 48. Rotation of the axle 48 Causes the second gear 51 to also rotate which communicates this action to the conveying chain 52. The conveying chain 52 is also drawn around the second rotating axle 54 and gear 56. Unlike the power chain 46, the conveying chain 52 is not an endless chain, the ends of the chain are fixedly attached to a billet moving frame 64.

The billet moving frame 64 comprises a pusher 66, a support beam 68, a nozzle mounting 70 and a track means 72. The track means 72 (FIG. 11) are mounted to the underside of the horizontal guide beam 30 and provide efficient movement of the billet moving frame 64 along the length of the guide beam 30. The pusher 66 is mounted at one end of the support beam 68 and extends vertically downward to a point below the centerline of the billet 16. The nozzle mounting 70 is fixedly attached to the other end of the support beam 68 and extends to a point at least to the centerline of the billet 16. The conveying chain 52 is fixedly attached to a flange 74 of the support beam 68.

The nozzle mounting 70 comprises a circular nozzle cover 76, a nozzle 78 and a support flange 79. The nozzle cover 76 is of a diameter less than or equal to the diameter of the billet 16 and is manufactured from a sufficiently resilient and heat resistant material to push the quenched billet 16 along the rails 32 when force is applied to the nozzle mounting 70. The nozzle 78 is mounted along the center axis of the nozzle cover 76. The nozzle 78 is supplied with a source of coolant from the reservoir 26 by suitable means (not shown).

Figure 3:
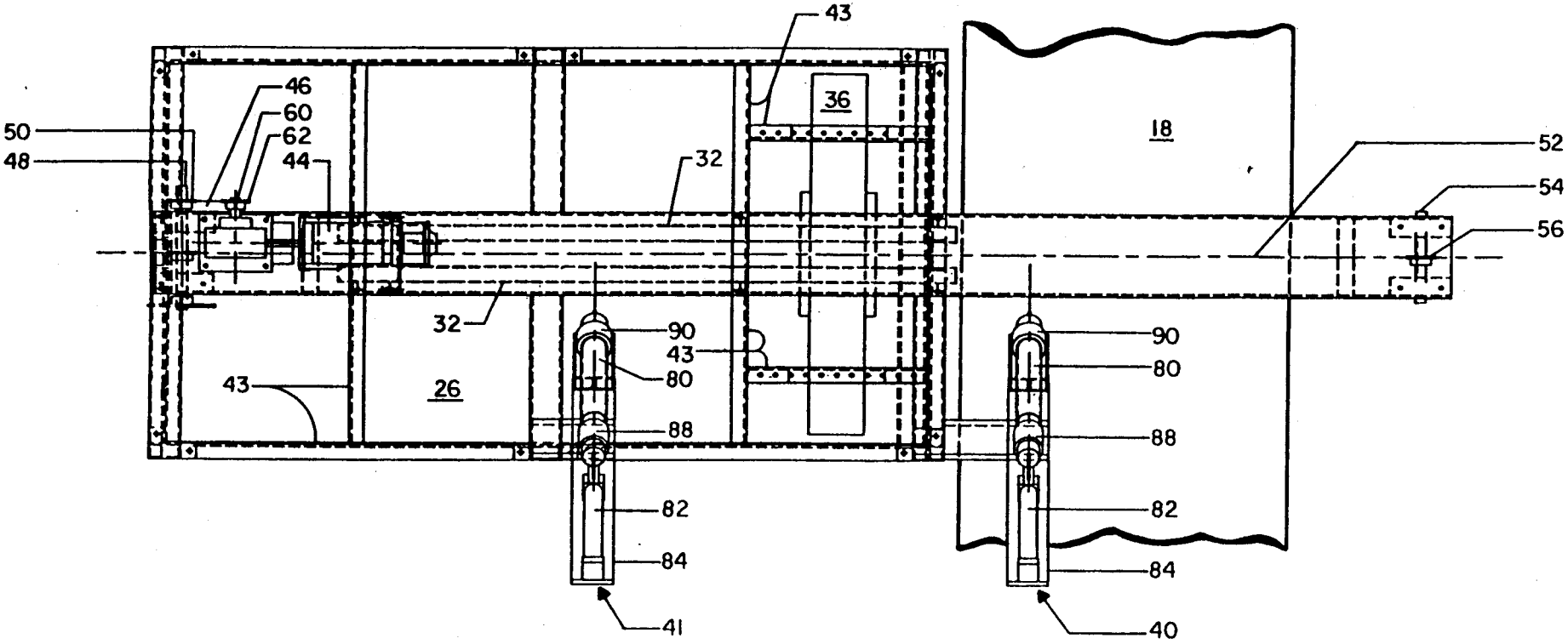
FIG. 3 is an overhead view of the solutionizing taper quench apparatus.

As seen in FIG. 3, the guide rails 32 and spray ring housing 36 are fixedly attached to the horizontal cross members 43 of the support frame 28. The guide rails 32 extend much of the length of the reservoir 26 and the spray ring housing 36 is mounted at a point above the reservoir 26 and interacts with the guide rails 32 as discussed below. The guide beam 30 extends over the billet conveyor 18 and the reservoir 26. One temperature measuring means 40 is mounted on one side of the spray ring housing 36 and a second temperature measuring means 41 is mounted on the other side thereof.

Figure 4:
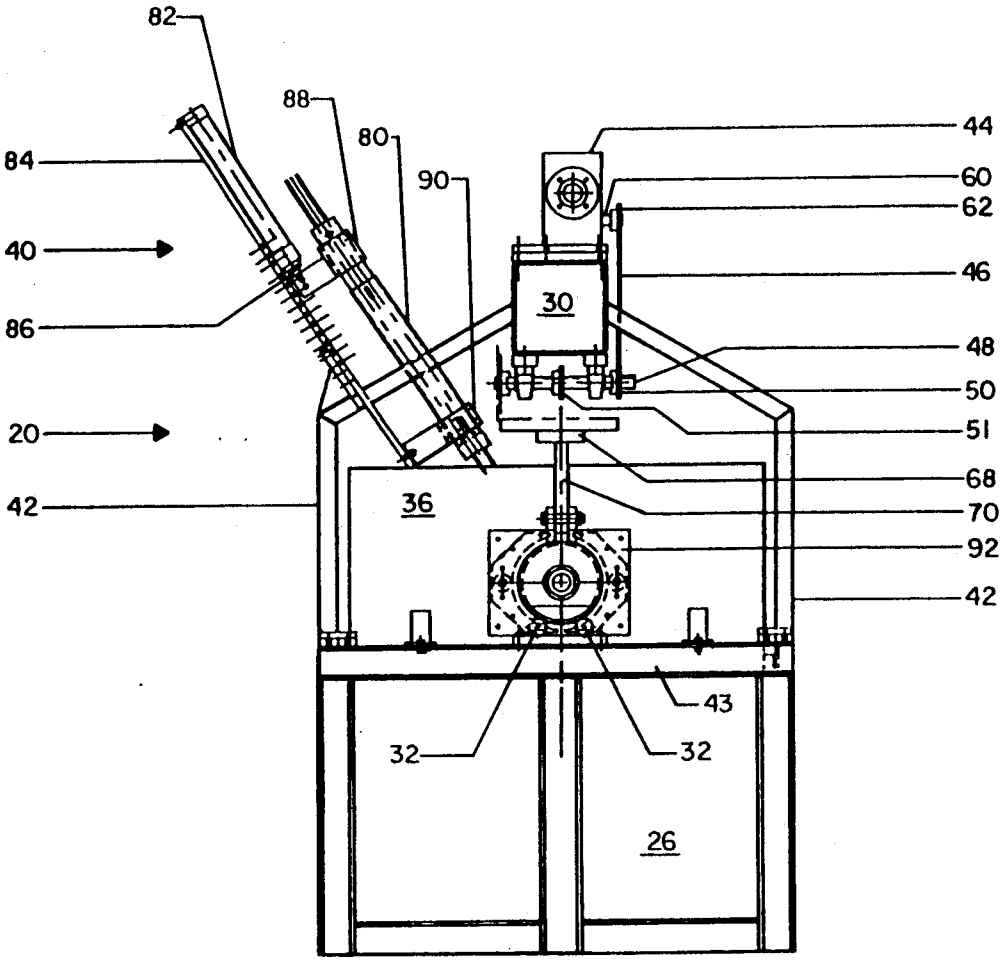
FIG. 4 is an end elevational view of the solutionizing taper quench apparatus.

As seen in FIG. 4, the temperature sensing means 40 comprises a conventional thermocouple 80 and a pressurized air cylinder 82 for movement of the thermocouple 80. The cylinder 82 is fixedly mounted to a support bar 84 which is in turn fixedly attached to one of the support legs 42. One end of a push rod 86 of the cylinder 82 is fixedly attached to a clamp 88 which is fixedly attached to one end of the thermocouple 80. The other end of the thermocouple 80 is slidably supported by bushings 90 or other suitable means. In operation, as the push rod 86 is extended from the cylinder 84, the thermocouple 80 slides through the bushings 90 and approaches the billet 16. When the thermocouple 80 contacts the billet, a temperature reading of the surface of the billet 16 can be recorded for analysis. The thermocouples 80 may be mounted on any of the support legs 42 or by suitable means (now shown) at differing positions along the horizontal guide beam 30 to measure the temperature of the billet 16 at various points in the quenching operation. The structure of the temperature sensing means 41 is the same as that of the temperature sensing means 40.

Figure 5:
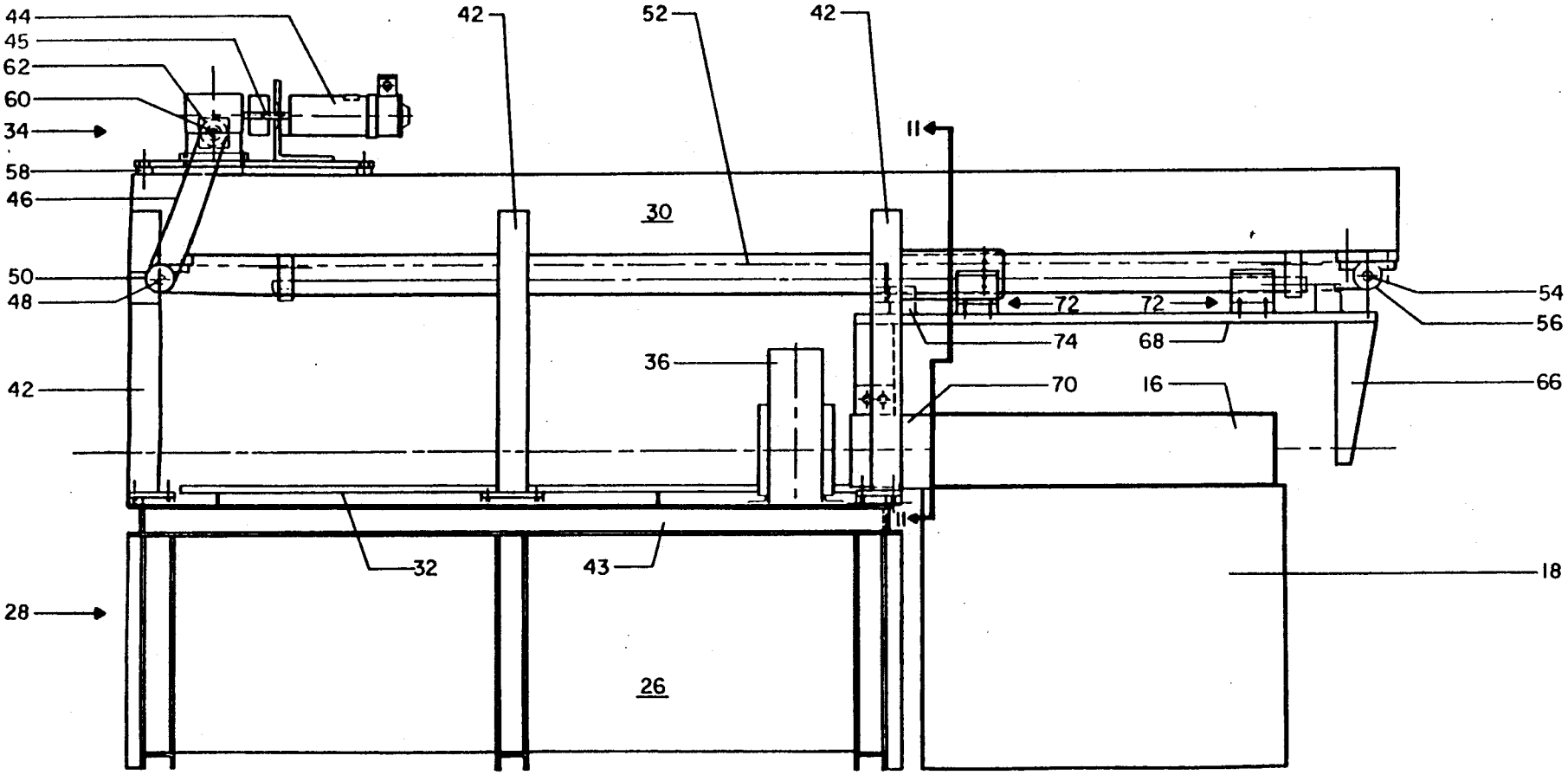
FIG. 5 is a side elevational view of the solutionizing taper quench apparatus during discharge of a conditioned billet.

In operation, the billet 16 is transferred to a point adjacent the guide rails 32 as seen in FIG. 5, this is the loading and discharge state. At this point, the pusher 66 is on one side of the end of the billet 16 whereas the nozzle cover 76 is on the other side of the end of the billet 16. To move the billet 16 through the quenching operation, the electric motor 44 drives the endless power chain 46 which in turn rotates the conveying chain 52 and drives the billet moving frame 64 toward the electric motor 44. The pusher 66 contacts one end of the billet 16 and advances it along the guide rails 32. The billet enters the spray ring housing 36, and is subjected to a quenching operation, as described below. After all or only a portion of the length of the billet 16 has moved through the spray ring housing 36 (as seen in FIG. 2), the motor 44 is reversed, thereby causing the pusher 66 to move away from the billet 16 and the nozzle cover 76 to contact the other end of the billet. The motor 44 drives the billet 16 back along the guide rails 32, through the spray ring housing 36 to the conveyor 18. As described below, the billet may be subjected to a variety of quenching operations as it reenters the spray ring housing 36 or as it contacts the nozzle cover 76 in order to create the desired temperature gradient throughout the billet 16.

Figure 6:
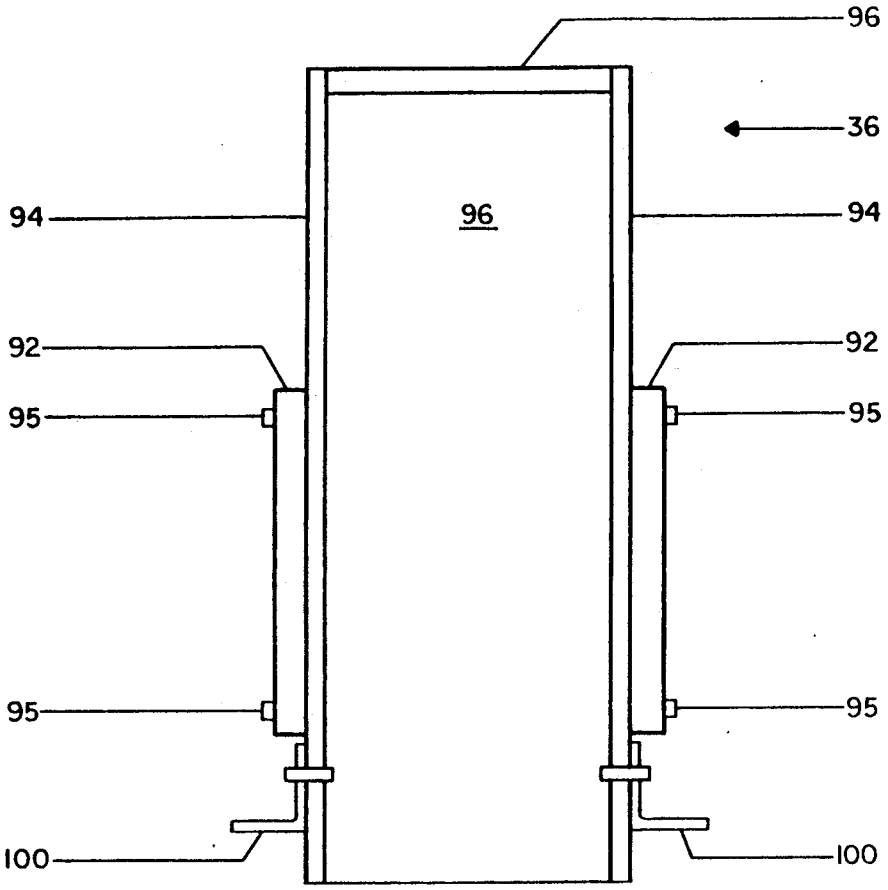
FIG. 6 is a side elevational view of the spray ring housing.

As seen in FIG. 6, the spray ring housing 36 in the preferred embodiment comprises a plurality of spray rings 92, a plurality of backing plates 94 and plurality of width plates 96. The spray rings 92 are fixedly attached to the backing plates 94 by a plurality of mounting screws 95. Further, the spray rings 92 are spaced a short distance apart as determined by the width of the width plates 96. The width of the width plates 96 can be varied and thereby change the spacing between the two spray rings 92 depending upon the quench conditions desired. The spray housing 36 is fixedly attached to the horizontal cross members 43 (FIG. 3) by suitable clamps 100.

The spray ring housing 36 only utilizes width plates 96 on the top and sides and therefore is open on the bottom. The bottom surface of the spray ring housing 36 is above the reservoir 26. Therefore, the cooling medium is easily returned to the reservoir 26 by the force of gravity. In the preferred embodiment, the spray rings 92 are constructed of a suitable durable steel, the backing plates 94 are constructed of stainless steel and some of the width plates 96 are constructed of stainless steel whereas others are transparent plexiglass.

Figure 7:
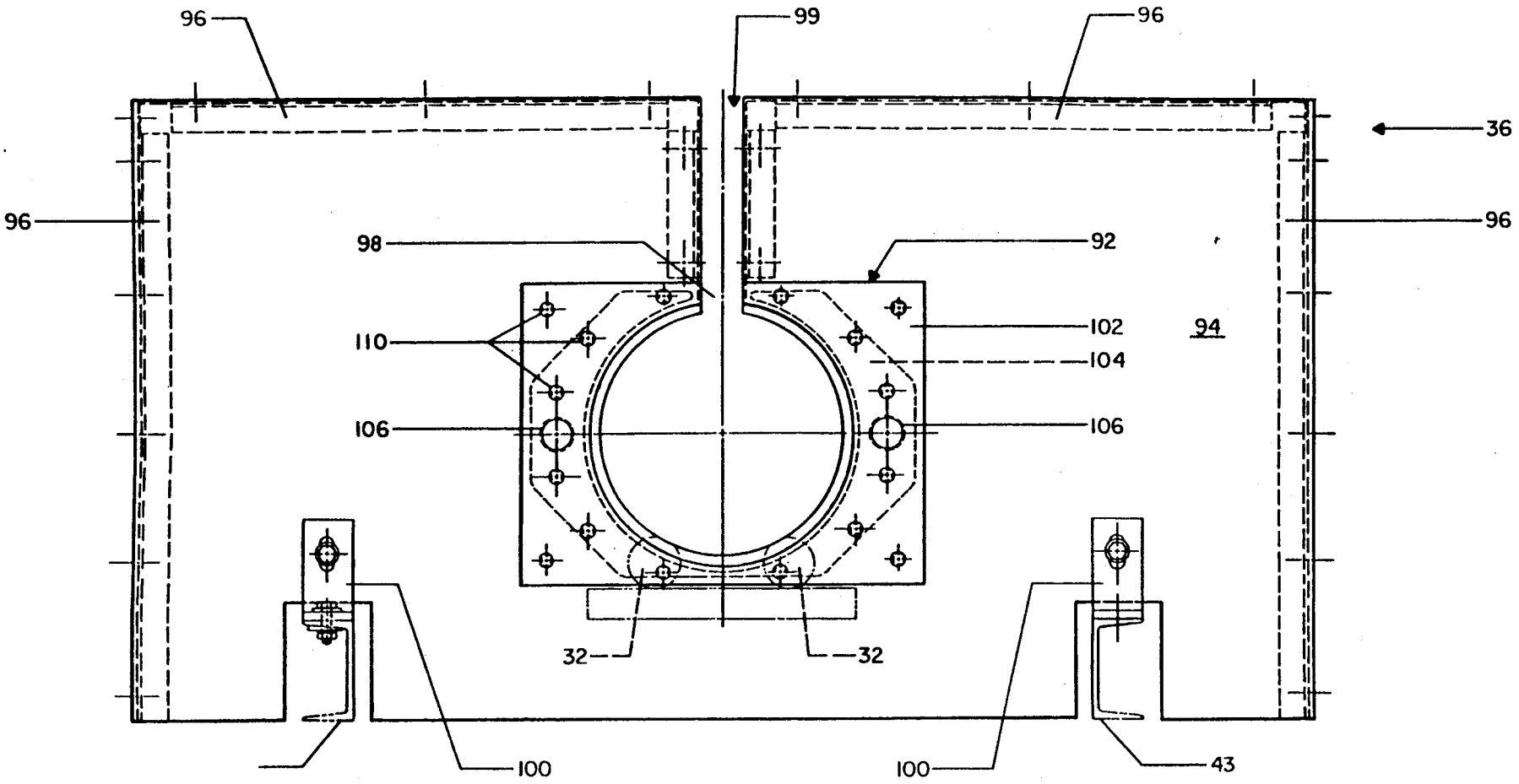
FIG. 7 is a front elevational view of the spray ring housing.

FIG. 7 shows in greater detail the construction of the spray rings 92 and backing plates 94. As seen in FIG. 7, the spray ring is actually not a complete ring but has a radial opening 98 on the upper most side of the ring 92. The opening 98 allows for the easy movement of the pusher 66 and nozzle support flange 79 through the spray ring housing 36. The backing plate 94 likewise has a slot 99 to accommodate the pusher 66 and nozzle support flange 79. Width plates 96 are also used along the slot 99 to contain the cooling medium. The spray ring housing 36 is fixedly attached to the horizontal cross members 43 by suitable means such as clamps 100.

Figure 8:
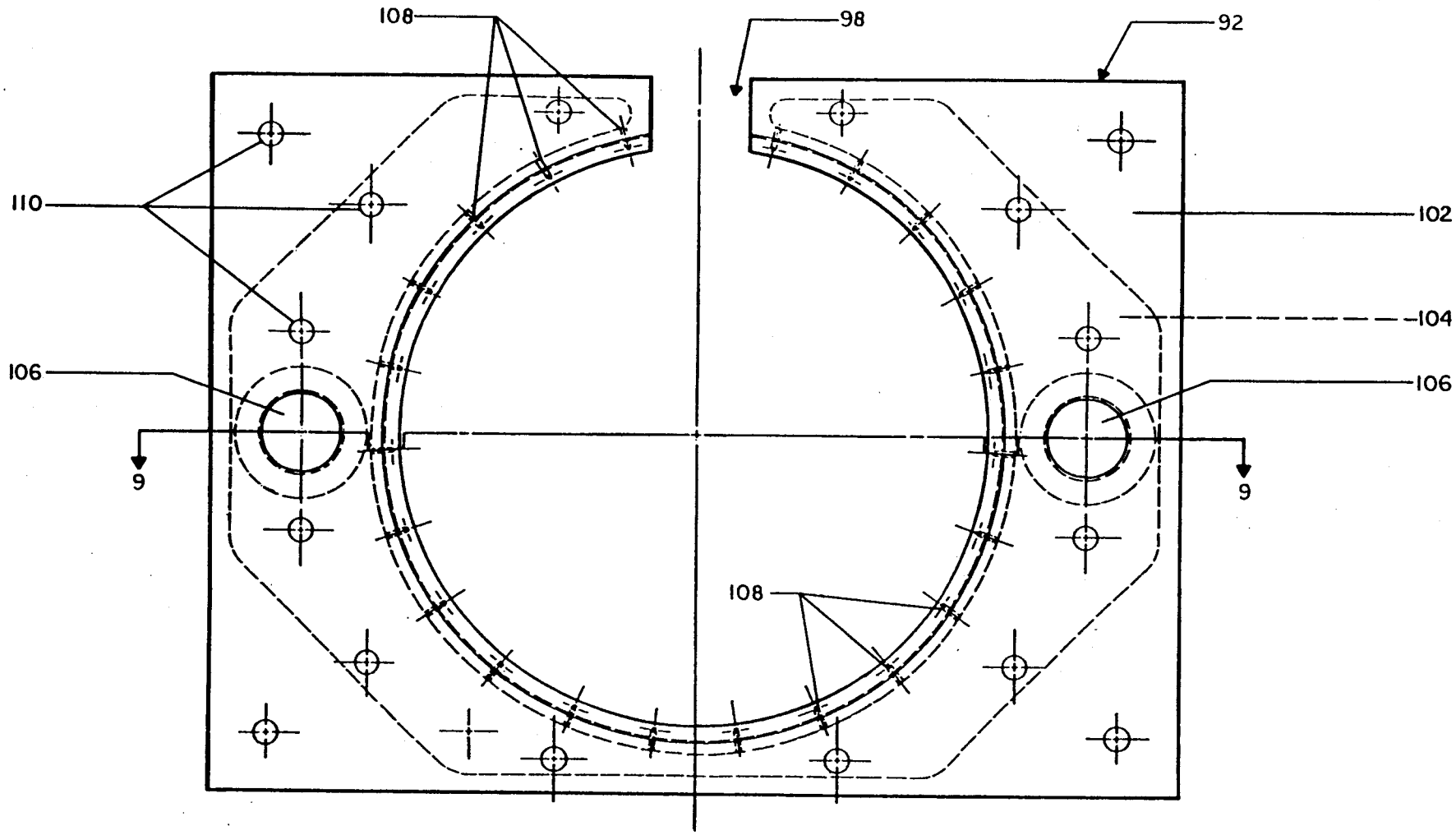
FIG. 8 is a partial sectional view of the spray ring of FIG. 7.

FIG. 8 shows in greater detail the design of the spray ring 92. The ring comprises a reasonably thick flat plate 102, a recess 104, a plurality of conduits 106 for supplying cooling medium, a plurality of spray nozzles 108, and a plurality of mounting holes 110 for securing the spray ring 92 to the backing plate 94. Cut into the surface of the flat plate 102 of the spray ring 92 is a central cooling medium recess 104. The recess 104 is in communication with the spray nozzles 108 and acts as a reservoir for the cooling medium. The cooling medium or water is supplied to the recess 104 by the conduits 106. Pressurized cooling medium flows from the conduits 106 into the recess 104 and therefore flows out of the spray nozzles 108 at a uniform rate. This flow provides uniform application of the cooling medium to the entire surface of the hot billet 16. The mounting holes 110 are spaced throughout the flat plate 102 to secure the ring 92 to the backing plate 94. A seal may be created between the spray ring 92 and the backing plate 94 by use of a suitable sealant such as an 0-ring material in order to avoid inadvertent loss of the pressurized cooling medium.

Figure 9:
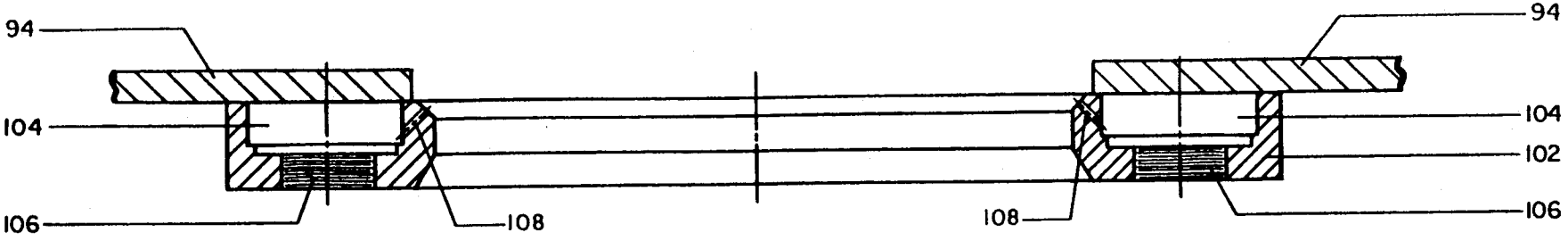
FIG. 9 is a partial sectional view of the spray ring taken along lines 9—9 of FIG. 8.

FIG. 9 shows the orientation of the nozzles in the spray ring housing 36. The spray nozzles 108 extend through the body of the spray ring 92 such that the spray is directed inwardly and the cooling medium may be contained within the spray ring housing 36 as much as possible. Both of the spray rings are directed inwardly to contain the cooling medium, although this orientation may be easily changed if necessary to change the resulting properties in the quenched billet. Use of two spray rings 92 in the housing 36 create an annular bank of cooling medium around the billet 16.

Figure 10:
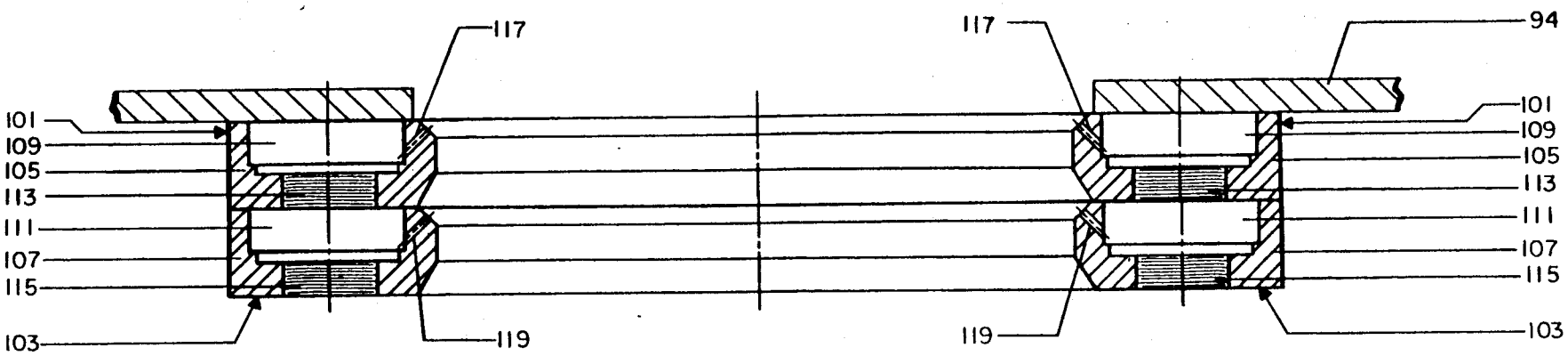
FIG. 10 is an alternative embodiment of the spray ring as seen in FIG. 9.

FIG. 10 shows an alternative embodiment wherein additional cooling medium may be applied. This embodiment comprises the use of a first and a second spray ring 101, 103. Each of the spray rings has the same design as seen in FIG. 9, i.e., a flat plate 105, 107, a cooling medium recess, 109, 111, conduits for the cooling medium supply, 113, 115, a plurality of spray nozzles, 117, 119, and a plurality of mounting holes (not shown). The first spray ring 101 and second spray ring 103 are mounted adjacent to each other to a backing plate 94. The first spray ring 101 is supplied with a suitable cooling medium such as water through the conduit 113. The cooling medium flows into the recess 109 of the first ring 101 and out the spray nozzles 117 of the first ring 101. Likewise, the second cooling ring 103 is supplied through the conduit 115 with a suitable cooling medium which may be different from that supplied to the first ring 101. The second cooling medium flows into the recess 111 of the second ring 103 and out the nozzle 119. In the preferred embodiment, the cooling medium utilized in the first spray ring is water whereas the cooling medium in the second spray ring is air. The nozzles 117, 119 are in close relation to each other and are directed to the billet at the same angle. The use of air in conjunction with water allows the air to contain the water within the spray ring housing. In addition, the air provides a further source for creating the preferred temperature gradient along the length of the billet.

Figure 11:
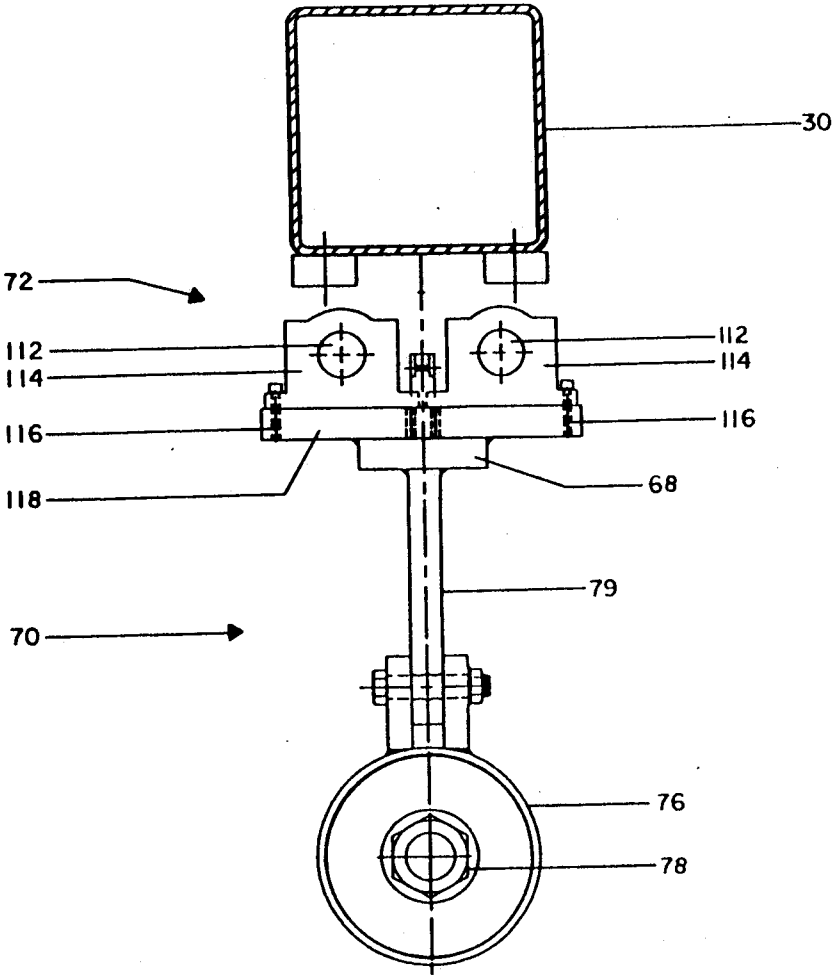
FIG. 11 is a partial sectional view of the spray ring apparatus taken along lines 11—11 of FIG. 5.

As seen in FIG. 11, the support beam 68 is slidably mounted on the track means 72. The track means 72 comprise a plurality of track rails 112 and a plurality of bushings 114. The track rails 112 are supported on the underside of the horizontal guide beam 30 on each end of the rails 112 (not shown). Slidably mounted on the rails 112 are the bushings 114. The bushings in turn are fixedly attached to the support beam 68 by a plurality of mounting screws 116 and a mounting plate 118. The mounting plate 118 is welded to the support beam 68 and the mounting screws 116 fixedly attach the bushing 114 to the mounting plate 118.

Figure 12:
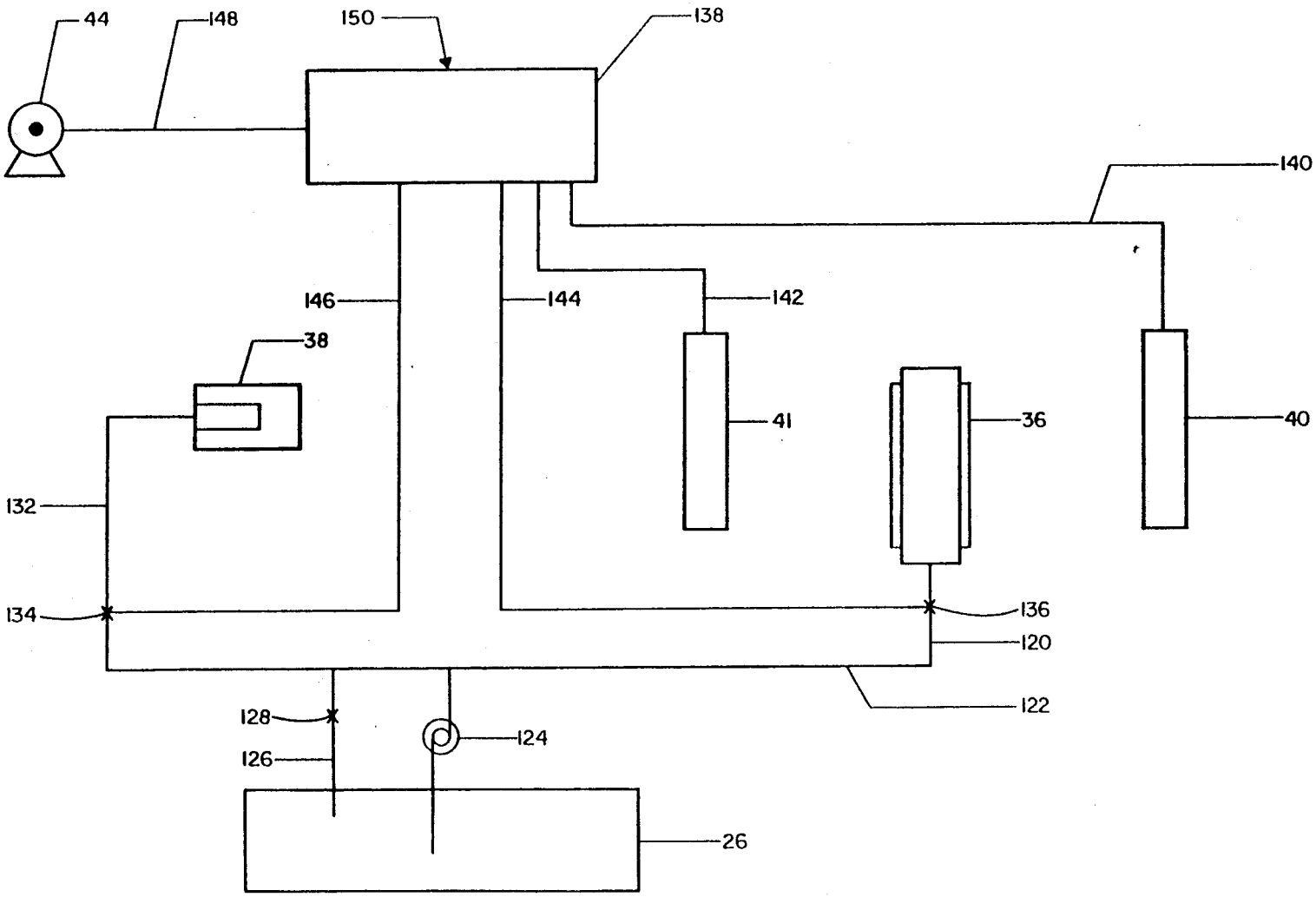
FIG. 12 is a schematic representation of a control system to operate the taper quench according to the invention.

The control of the taper quenching apparatus will be described with reference to FIG. 12 which is a schematic of a control system for operating the taper quench according to the invention. Like numerals have been used to designate like parts.

The spray ring housing 36 is supplied with water from a water supply branch 120 which is connected to the reservoir 26 through water supply 122 and pump 124. The water supply line has a return line 126 and a check valve 128 to return water to the reservoir 26 in the event that the pressure in water supply line 122 downstream of pump 124 reaches a predetermined value.

A control valve 136 is positioned in the water supply branch 120 to control the flow of water therethrough.

The end quench means 38 is connected to the reservoir 26 through water supply line 122 and branch line 132. A valve 134 is positioned in the branch line 132 to control the flow of water therethrough.

A controller 138 is connected to the temperature sensing means 40 through control line 140. The controller communicates with temperature sensing means 41 through control line 142. The controller 138 is connected to the flow control valve 136 through control line 144. The controller 138 is connected to the flow control value 134 through control line 146. The controller 138 is also connected to the motor 44 through control line 148. Various inputs can be provided to the controller including a temperature profile input 150.

The controller 138 can be any suitable controller which is adapted to control the motor 44 and the valves 136 and 134 to control the flow of water through the branch lines 120 and 132 in response to temperatures detected by the temperature sensing means 40 and 41 to reach the predetermined temperature profile 150 which has been input into the controller 138. The controller 138 can be any suitable hardwire apparatus for conducting these functions or can be a computer processor with a suitable computer program.

While particular embodiments of the invention have been shown, it will be understood, of course, that the invention is not limited thereto since modifications may be made by those skilled in the art, particularly in light of the foregoing teachings. Reasonable variation and modification are possible within the foregoing disclosure of the invention without departing from the scope of the invention.

We claim:

1. A method for conditioning an aluminum alloy billet for extrusion wherein the billet has a hot working temperature suitable for extrusion purposes, comprising the steps of:

heating the aluminum alloy billet to a temperature sufficient to solutionize the elements in the aluminum matrix;

cooling the billet to a temperature below the solutionizing temperature and non-uniformly to produce a temperature gradient along the length thereof wherein one end of said billet has a temperature above the hot working temperature of the billet and the other end thereof is below the hot working temperature of the billet;

whereby the billet can be extruded by placing the billet into an extrusion press with the hot end of the billet adjacent a die opening and the cooler portions of the billet will heat to the hot working temperature as the billet is extruded so that the extrusion resulting therefrom has substantially uniform properties along the length thereof and the defects of tearing and hot shorting of the extrusions are minimized.

2. A method for conditioning an aluminum alloy billet for extrusion according to claim 1 wherein the said elements in the aluminum matrix comprise magnesium and silicon.

3. A method for conditioning an aluminum alloy billet for extrusion according to claim 1 wherein the solutionizing temperature is in the range of 820° to 1010° F.

4. A method for conditioning an aluminum alloy billet for extrusion according to claim 1 wherein the hot working temperature is in the range of 500° to 950° F.

5. A method for conditioning an aluminum alloy billet for extrusion according to claim 1 wherein the cooler end of the billet is cooled to as much as 200° F. cooler than the other end of the billet.

6. A method for conditioning an aluminum alloy billet for extrusion according to claim 2 wherein the solutionizing temperature is in the range of 960° to 1010° F.

7. A method for conditioning an aluminum alloy billet for extrusion according to claim 2 wherein the hot working temperature is in the range of 500° to 950° F.

8. A method for conditioning an alluminum alloy billet for extrusion according to claim 2 wherein the cool end of the billet is cooled to as much as 200° F. cooler than the other end of the billet.

9. A method for conditioning an aluminum alloy billet for extrusion according to claim 6 wherein the hot working temperature is in the range of 960° to 1010° F.

10. A method for conditioning an aluminum alloy billet for extrusion according to claim 6 wherein the cool end of the billet is cooled to as much as 200° F. cooler than the other end of the billet.

11. A method for conditioning an aluminum alloy billet for extrusion according to claim 9 wherein the cool end of the billet is cooled to as much as 200° F. cooler than the other end of the billet.

12. A method for conditioning an aluminum alloy billet according to claim 1 wherein a predetermined temperature profile is accomplished along the length of the billet.

13. A method for conditioning an aluminum alloy billet according to claim 1 and further comprising extruding the metal billet with uniform properties throughout the billet and minimal hot shorts and surface defects on the extruded product.

14. An apparatus for conditioning a billet for extrusion wherein a furnace has means to heat the billet to a solutionizing temperature and an extrusion press has means for extruding the billet to an extruded shape and a conveyor transfers the heated billet from the furnace to the conditioning apparatus, then to the extrusion press, the conditioning apparatus comprising:

cooling means for directing a cooling fluid in a uniform band around the billet, the cooling means having an opening therethrough for passing the billet;

means for moving the billet with respect to the cooling means so that the billet moves through a least a portion of the cooling means to cool the billet; and control means for controlling the relative movement of the billet and controlling the supply of cooling fluid to the cooling means, to develop a temperature gradient along the length of the billet as the billet passes through at least a portion of the cooling means and to reduce the temperature of the billet below the solutionizing temperature.

15. An apparatus for conditioning a billet for extrusion according to claim 14 wherein the control means further comprises means to control the flow of the cooling fluid to the cooling means.

16. An apparatus for conditioning a billet for extrusion according to claim 15 wherein the control means further comprises means for detecting the temperature of the billet.

17. An apparatus for conditioning a billet for extrusion according to claim 15 wherein said control means develops a predetermined temperature profile along the length of the billet.

18. An apparatus for conditioning a billet for extrusion according to claim 17 wherein said control means further comprises means for detecting the temperature of the billet.

19. An apparatus for conditioning a billet for extrusion according to claim 14 wherein the control means develops a predetermined temperature profile along the length of the billet.

20. An apparatus for conditioning a billet for extrusion according to claim 14 wherein the control means further comprises means for detecting the temperature of the billet.

21. An apparatus for conditioning a billet for extrusion according to claim 20 wherein the temperature detecting means measures the temperature after the billet passes through the cooling means.

22. An apparatus for conditioning a billet for extrusion according to claim 20 wherein the temperature is measured by the temperature detecting means before the billet passes through the cooling means.

23. An apparatus for conditioning a billet for extrusion according to claim 22 wherein the temperature detecting means measures the temperature of the billet after the billet passes through the cooling means.

24. An apparatus for conditioning a billet for extrusion according to claim 14 wherein said moving means moves the billet from a conveyor through at least a portion of the cooling means.

25. An apparatus for conditioning a billet for extrusion according to claim 24 wherein said conveyor is adapted to move said billet in a given direction and said moving means comprises a pusher mounted on guide means for movement of the billet in a direction transverse to the given direction of billet movement.

26. An apparatus for conditioning a billet for extrusion according to claim 14 wherein the cooling means comprises at least one spray ring to distribute the cooling fluid in a circular band around the billet.

27. An apparatus for conditioning a billet for extrusion according to claim 26 wherein the cooling means comprises means for directing cooling fluid against one end of the billet.

28. An apparatus for conditioning a billet for extrusion according to claim 26 wherein said spray ring has a radial opening to permit passage therethrough of a pusher.

29. An apparatus for conditioning a billet for extrusion according to claim 26 wherein the cooling means comprises a spray ring having a plurality of radially directed nozzles adapted to direct cooling fluid against the billet.

30. An apparatus for conditioning a billet for extrusion according to claim 29 wherein the spray ring further comprises a plate having a circular opening, wherein the nozzles are formed on an inside surface of the circular opening, and the plate further having a central recess in communication with the nozzles and means for supplying cooling fluid to the central recess.

31. An apparatus for conditioning a billet for extrusion according to claim 14 wherein the cooling means comprises means for directing cooling fluid against one end of the billet.

32. An apparatus for conditioning a billet for extrusion according to claim 14 wherein cooling means comprises means to spray water on to the billet in a circular band and means to spray air toward the edge of the circular band to contain the water within the band.

33. An apparatus for conditioning a billet for extrusion according to claim 14 wherein said cooling means comprises first and second spray rings spaced axially from each other to direct the cooling fluid on to the billet in a circular band.

34. An apparatus for conditioning a billet for extrusion according to claim 33 wherein said cooling means further comprises means to vary the axial spacing between said first and second spray rings.

35. An apparatus for conditioning a billet for extrusion according to claim 14 wherein billet moving means comprises a frame having a guide beam supported above the conveyor and the cooling means further comprises an end cooling means for directing cooling fluid against the end of the billet, and means including a mounting means for supporting the end cooling means from the guide beam.

36. An apparatus for conditioning a billet for extrusion according to claim 35 wherein the cooling means further comprises a spray ring which has a radial opening to permit passage therethrough of the mounting means for the end cooling means.

37. An apparatus for conditioning a billet for extrusion according to claim 35 wherein the billet moving means further comprises guide rails for supporting the billet as it moves through a portion of the cooling means.

* * * * *